US009300080B2

(12) United States Patent
Puluc

(10) Patent No.: US 9,300,080 B2
(45) Date of Patent: Mar. 29, 2016

(54) TWIST LOCK CONNECTOR ASSEMBLY

(71) Applicant: R.A. Phillips Industries, Inc., Santa Fe Springs, CA (US)

(72) Inventor: Oscar A. Puluc, Downey, CA (US)

(73) Assignee: R.A. Phillips Industries, Inc., Santa Fe Springs, CA (US)

( * ) Notice: Subject to any disclaimer, the term of this patent is extended or adjusted under 35 U.S.C. 154(b) by 0 days.

(21) Appl. No.: 14/207,190

(22) Filed: Mar. 12, 2014

(65) Prior Publication Data

US 2014/0273577 A1 Sep. 18, 2014

Related U.S. Application Data

(60) Provisional application No. 61/801,229, filed on Mar. 15, 2013.

(51) Int. Cl.

| | |
|---|---|
| ***H01R 13/64*** | (2006.01) |
| ***H01R 13/62*** | (2006.01) |
| ***H01R 13/625*** | (2006.01) |

(52) U.S. Cl.

CPC ..... *H01R 13/62* (2013.01); *H01R 13/625* (2013.01)

(58) Field of Classification Search

CPC ..... H01R 13/625; H01R 13/623
USPC ..... 439/314, 315, 680
See application file for complete search history.

(56) References Cited

U.S. PATENT DOCUMENTS

| | | | | |
|---|---|---|---|---|
| 4,109,989 | A | 8/1978 | Snyder, Jr. et al. | |
| 4,179,179 | A | 12/1979 | Lowden | |
| 4,211,461 | A | 7/1980 | Wescott | |
| 4,637,674 | A | 1/1987 | Kobler | |
| 5,358,429 | A | 10/1994 | Mina | |
| 5,662,488 | A * | 9/1997 | Alden | 439/314 |
| 5,863,221 | A | 1/1999 | Castaldo | |
| 5,890,930 | A | 4/1999 | Gerow | |
| 6,007,362 | A | 12/1999 | Davis et al. | |
| 6,220,891 | B1 | 4/2001 | Hils | |
| 6,257,923 | B1 | 7/2001 | Stone et al. | |
| 6,533,465 | B1 | 3/2003 | Lesesky et al. | |
| 7,097,469 | B2 * | 8/2006 | Jacobs | 439/83 |
| 2008/0171456 | A1 * | 7/2008 | Vanzo | 439/164 |

OTHER PUBLICATIONS

Combined International Search Report and Written Opinion in corresponding PCT Application Serial No. US2012/054296 dated Nov. 27, 2012; 11 pages.

Society of Automotive Engineers (SAE); Standard SAE 3560, revision of Jul. 1998, titled Seven Conductor Electrical Connector for Truck-Trailer Jumper Cable; Warrendale, PA 15096-0001, (11 pages).

* cited by examiner

*Primary Examiner* — Abdullah Riyami
*Assistant Examiner* — Thang Nguyen
(74) *Attorney, Agent, or Firm* — Lewis Roca Rothgerber Christie LLP

(57) ABSTRACT

An electrical connector including a substantially tubular housing for housing an electrical terminal, and a substantially cylindrical electrical terminal holder configured to be inserted into the housing, the electrical terminal holder being configured to hold the electrical terminal, wherein the electrical terminal holder and the housing are configured to be mechanically engaged by twisting the electrical terminal holder with respect to the housing after being inserted therein.

17 Claims, 7 Drawing Sheets

TWIST LOCK CONNECTOR ASSEMBLY

CROSS-REFERENCE TO RELATED APPLICATIONS

This utility patent application claims the benefit of, and the priority to, U.S. Provisional Application Ser. No. 61/801,229, filed Mar. 15, 2013, entitled TWIST LOCK CONNECTOR ASSEMBLY, the entire contents of which is incorporated herein by reference. This utility patent application expressly incorporates the disclosure and contents of copending application Ser. No. 13/368,249, entitled JUMPER CABLE PLUG WITH MOISTURE RESISTANT SEAL, and issued U.S. Pat. No. 7,097,469, entitled CONTACT INSERT CARTRIDGE FOR PLUGS OF TRACTOR/TRAILER JUMPER CABLES, in their entirety.

BACKGROUND

1. Field

Embodiments of the present invention relate generally to Electrical plugs and sockets such as, but not limited to, jumper cable plugs and sockets used to electrically connect jumper cables between and trailer and a tractor, truck, other trailer, etc.

2. Description of Related Art

Heavy duty trucks and tractor trailers typically involve a semi-trailer truck, or a tractor-trailer, having a trailer connected thereto. The trailer typically requires one or more electrical systems associated with turn signals, hazard signals, brake signals, braking systems, system monitoring, lighting, etc. These electrical systems are typically controlled or monitored from within the cab of the semi/tractor. Accordingly, an electrical connection is typically required between the semi/tractor and the trailer. Because the trailer is typically detachable from the semi/tractor, the electrical connection therebetween is also typically detachable. This detachable electrical connection typically takes the form of a plug-and-socket connection, wherein the socket may have one or more electrical connections (e.g., male pins) for mating with corresponding electrical connections (e.g., female terminals) of the plug.

When the plug includes the female terminals, the plug may be formed of two or more different components for setting the female terminals, which are connected to various electrical wires, and for housing the terminal-wire connections. For example, the electrical wires may be passed through a generally cylindrical housing (e.g., generally tubular housing), and may then be connected to the female terminals at a separate electrical terminal holder. Then, the generally cylindrical housing may be slid forward along the wires so that one end of the electrical terminal holder is inserted into an opening at a front of the generally cylindrical housing. Thereafter, the electrical terminal holder is typically secured to the generally cylindrical housing, and a seal may be provided where the electrical terminal holder and the generally cylindrical housing meet (e.g., around a circumference of the electrical terminal holder and at a front of the generally cylindrical housing). Accordingly, the electrical terminal holder and the generally cylindrical housing are physically coupled with the terminals and wires therein to form the plug.

Various methods and structures for connecting or securing the electrical terminal holder to the generally cylindrical housing may be used. One way includes inserting the electrical terminal holder into the cylindrical housing, and then passing a screw through the wall of the cylindrical housing and into the side of the electrical terminal holder.

However, a metal screw may damage or wear the material of the electrical terminal holder and the cylindrical housing (e.g., plastic). Furthermore, the hole, or holes, through which the screw passes may allow for water or debris to enter into the plug, thereby potentially damaging or weakening the electrical connections therein.

Additionally, when being used in the field, an event may occur that requires separation of the electrical terminal holder from the cylindrical housing (e.g., to debug or repair electrical continuity). This may require a screw driver that the truck operator might not have. Further, if weather conditions are poor, there may be added time and difficulty associated with removing the screw from the plug. Also, if the screw is dropped or lost, the plug may be unusable until a replacement screw allows for the electrical terminal holder to be re-secured to the cylindrical housing.

SUMMARY

According to embodiments of the present invention, there is provided an improved jumper cable plug wherein separate components of the jumper cable plug may be connected in a manner that may be described as self-connecting (e.g., without the use of additional components or tools, such as a screw and screwdriver).

According to embodiments of the present invention, a jumper cable plug includes a generally cylindrical, or tubular, housing and a generally cylindrical electrical terminal holder that are locked, or engaged, with one another by inserting the electrical terminal holder into the housing, and twisting, or turning, the two with respect to one another.

According to one embodiment of the present invention, there is provided an electrical connector including a substantially tubular housing for housing an electrical terminal, and a substantially cylindrical electrical terminal holder configured to be inserted into the housing, the electrical terminal holder being configured to hold the electrical terminal, wherein the electrical terminal holder and the housing are configured to be mechanically engaged by twisting the electrical terminal holder with respect to the housing after being inserted therein.

The housing may include a first ridge at an inner wall of the housing and extending a length direction of the housing, the ridge and the inner wall of the housing may define a first keyway and a second keyway that are separated by a first ridge, the terminal holder may include a second ridge corresponding to the first ridge and located at a side of the terminal holder and extending in a length direction of the terminal holder, the second ridge may be configured to be inserted into the first keyway when the terminal holder is inserted into the housing, and the second ridge may be configured to pass the first ridge to reside in the second keyway when the terminal holder is twisted with respect to the housing.

The housing may include a keyway defined by an inner wall of the housing and extending a length direction of the housing, the terminal holder may include a wedge-shaped protrusion at a side of the terminal holder, and the wedge-shaped protrusion may be configured to fit in the keyway of the housing when the terminal holder is twisted with respect to the housing.

The housing may include a protrusion at an inner wall of the housing, and the terminal holder may include a slot at a side of the terminal holder that is configured to have the protrusion situated therein.

The terminal holder may be configured to engage the protrusion in the slot when the terminal holder is twisted with respect to the housing.

According to another embodiment of the present invention, there is provided an electrical connector including a substantially tubular housing having a front end, a rear end, and a side wall between the front end and the rear end and including one or more protrusions on an inner side of the side wall, and a substantially cylindrical electrical terminal holder including a front, a rear, and a side between the front and rear and defining one or more slots corresponding to the one or more protrusions of the tubular housing, wherein the protrusions are configured to be engaged with corresponding ones of the slots when the electrical terminal holder is inserted into the housing.

The protrusions may be configured to be engaged with the corresponding ones of the slots when the electrical terminal holder is inserted into the housing and twisted with respect to the housing.

Each of the one or more slots may have a first portion extending a length direction of the holder and having an opening at the rear of the holder, and a back between the front and the rear of the holder, and a second portion extending from the back of the first portion at an angle to the first portion.

Each of the one or more slots may be further defined by a ridge where the first portion meets the second portion and that is configured to exert a biasing force on a corresponding one of the protrusions in the second portion.

The side wall of the housing may define a first keyway and a second keyway extending from the front end toward the rear end, the side wall of the housing may further include a first ridge at the inner side of the side wall and extending from the front end toward the rear end, the first ridge defining respective edges of the first and second keyways, and the electrical terminal holder may further include a second ridge on the side of the terminal holder and extending in a length direction of the electrical terminal holder.

The second ridge may be configured to pass from the first keyway over the first ridge and into the second keyway when the terminal holder is inserted into the housing and twisted with respect to the housing.

The first and second ridges may be wedge-shaped, the first ridge having a first flat end extending radially inward from the inner sidewall, and the second ridge having a second flat end extending radially outward from the side of the terminal holder, and the first flat end may be configured to abut second flat ends when the electrical terminal holder is inserted into the housing and twisted with respect to the housing.

The electrical terminal holder may further include a flange at the front of the electrical terminal holder, the flange having an outer diameter approximately equal to an outer diameter of the housing, and a groove may be defined by the flange, the side of the electrical terminal holder, and the front end of housing when the terminal holder is twisted inserted into the housing and twisted with respect to the housing.

The groove may be configured to accommodate a seal configured to prevent or reduce moisture or debris passing into the front of the housing.

The inner side of the side wall of the housing may define a keyway extending from the front end of the housing toward the rear end of the housing, the side of the electrical terminal holder may include a wedge corresponding to the keyway of the housing, and a flat side of the wedge extending outwardly from the side of the electrical terminal holder may be configured to abut a portion of the inner side of the side wall of the housing that defines a portion of the keyway when the electrical terminal holder is inserted into the housing and twisted with respect to the housing.

The wedge may be sloped in a length direction of the terminal holder, and may also be sloped in a circumferential direction of the terminal holder.

The wedge may be configured to be wedged beneath an area of the housing next to the keyway to slightly deform the housing when the terminal holder is inserted into the housing, and may be configured to pass into the keyway when the terminal holder is twisted with respect to the housing.

DETAILED DESCRIPTION

Figure 1:
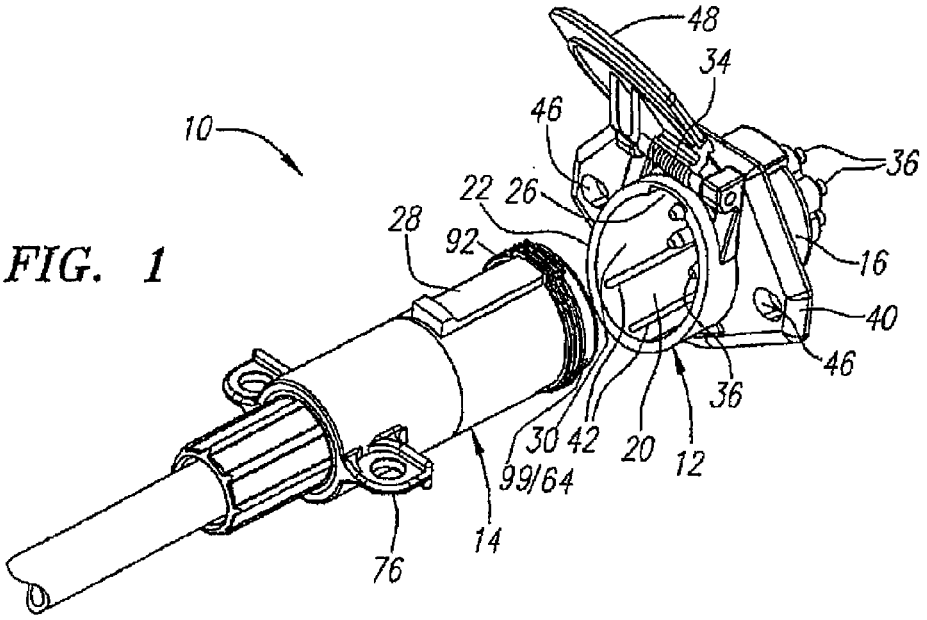
FIG. 1 is a perspective view of a socket and a jumper cable plug (shown an unmated position) in accordance with one embodiment of the present invention.

While exemplary embodiments of the invention are susceptible to various modifications and alternative forms, specific embodiments are shown by way of example in the drawings, and will herein be described in detail. It should be understood, however, that there is no intent to limit exemplary embodiments of the invention to the particular forms disclosed, but conversely, exemplary embodiments of the invention are to cover all modifications, equivalents, and alternatives falling within the spirit and scope of the invention. In the following description of the present invention, a detailed description of known functions and configurations incorporated herein will be omitted when it may make the subject matter of the present invention less clear.

It will be understood that, although the terms first, second, etc. may be used herein to describe various elements, these elements should not be limited by the strict construction of these terms. These terms are only used to distinguish one element from another.

The terminology used herein is for the purpose of describing particular embodiments only, and is not intended to be limiting of the present invention. As used herein, the singular forms "a," "an," and "the" are intended to include the plural forms as well as the singular, unless the context clearly indicates otherwise. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

Hereinafter, embodiments of the present invention will be described in detail by explaining exemplary embodiments of the invention with reference to the attached drawings. Like reference numerals in the drawings denote like elements, and repeated descriptions thereof will be omitted.

Furthermore, for ease of description, reference to a "front" of a plug, socket, or a component thereof, shall generally refer to a portion that is most proximate a mating end of the plug or socket, while reference to a "rear" of a plug, socket, or component thereof, shall generally refer to a portion that is least proximate the mating end of the plug or socket.

Exemplary embodiments of the present invention are described with reference to FIGS. 1-16 below. Plugs (e.g., jumper cable plugs) of the exemplary embodiments of the present invention, as well as sockets of the exemplary embodiments of the present invention, incorporate numerous aspects, and it should be noted that the present invention is not restricted to the exemplary embodiments, as various combinations of the described aspects may be made without departing from the spirit and scope of the present invention.

Figure 2:
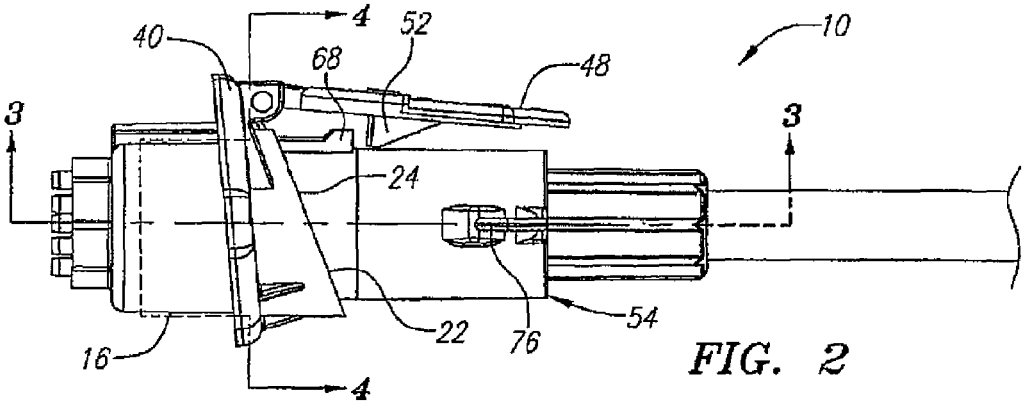
FIG. 2 is a side elevational view of the plug and the socket (shown in the mated position) of the embodiment shown in FIG. 1.

FIG. 1 is a perspective view of an electrical connection interface 10 of an embodiment of the present invention having a socket 12 and a jumper cable plug 14, which are shown in an unmated condition. FIG. 2 is an elevated view of the socket 12 and the plug 14 of the embodiment shown in FIG. 1, the socket 12 and the plug 14 being shown in a mated condition.

The plug 14 includes a plug housing 54 having a key 28, an electrical terminal holder (e.g., an electrical connection holder) 64 partially housed by the housing 54, and a seal ring 92 about the electrical terminal holder 64 between the housing 54 and a front of the electrical terminal holder 64, the seal ring 92 having a shape allowing a rear of the seal ring 92 to conform to the front 66 of the housing 54 (shown in FIGS. 7, 8, and 11) including the key 28. Accordingly, when the plug 14 is mated with the socket 12, an outer portion of the seal ring 92 is brought in close contact with an interior 30 of the socket 12 to form a moisture resistant seal.

The plug 14 of the present embodiment includes a generally tubular/cylindrical housing 54, while the socket 12 includes a wall 22 that defines a generally cylindrical cavity 20 for receiving the plug 14, the cavity 20 being open at a front end 24 of the socket 12. The cavity 20 additionally includes a keyway 26 (e.g., a cutout) defined by an interior 30 of the wall 22 of the socket 12. The keyway 26 is shaped to accommodate the key 28 (e.g., a protrusion/protuberance, which may be longitudinal) formed on a side of the housing 54 of the plug 14. The key 28 may be integrally formed with the housing 54. The keyway 26 and the key 28 allow proper orientation of the plug 14 and the socket 12 during mating of the plug 14 and socket 12, and therefore also allow proper orientation of the electrical connections (e.g., male pins 36 and female terminals 38, shown in FIGS. 3-5) of the plug 14 and the socket 12. Although the present embodiment depicts the electrical terminal holder 64 having a plurality of holes extending therethrough in which respective ones of the electrical terminals 38 are set, and also depicts male pins 36 of the socket 12 and female terminals 38 of the plug 14, other embodiments may include different arrangements, for example, wherein the plug comprises male terminals, and the socket comprises female terminals, or wherein electrical connections are made without pins and terminals.

The interior surface 30 of a socket barrel 16 of the socket 12 of the present embodiment includes a plurality of elongated ribs 42 that extend in a longitudinal direction of the socket 12 to facilitate drainage of moisture or water from the cavity 20. In embodiments of the present invention, opposing ribs 42 may be provided on opposite sides of the interior surface 30 of the barrel 16 to ensure that the plug 14 remains properly spaced from interior surface 30. However, other embodiments of the present invention may include an interior surface of a socket that does not include ribs 42.

The socket 12 of the present embodiment includes one or more mounting holes 46 formed through a flange 40 of the socket 12 to facilitate mounting the socket 12 to an exterior wall of a semi/tractor or a trailer, although such mounting holes 46 are not necessary for the practice of invention.

The key 28 of the plug 14 of the present embodiment is formed on the plug housing 54 and extends longitudinally along the plug housing 54. A rear of the key 28 of the present embodiment may also comprise an additional protrusion/protuberance 68, which extends from the plug housing 54 further than a front of the key 28 (e.g., the protuberance 68 is thicker, or that sticks out from the side wall of the plug housing 54, than the remainder of the key 28). Although the present embodiment includes the additional protrusion/protuberance 68 other embodiments of the present invention may include the key 28 without the additional protrusion/protuberance 68, or with a differently located protrusion/protuberance. Furthermore, other embodiments may include differently shaped keys or key/protuberance combinations (such as a wedge-shaped key that has a slope that rises from front to back).

The socket 12 corresponding to the present embodiment may include a hinged lid 48 including a biasing member 34, such as a torsional coil spring, to cause the lid 48 to cover an opening at the front of the cavity 20 when the socket 12 is unmated with the plug 14. The lid 48 may further include a locking tab 52, so that, while the plug 14 is mated to socket 12, the biasing member 34 biases the lid 48 towards the plug 14 (e.g., towards an upper surface of the plug 14). The biasing member 34 causes the locking tab 52 to contact a surface of the housing 54 rearward of the protuberance 68 or the rear end of the key 28, causing the locking tab 52 of the lid 48 to act as a stop by contacting the protuberance 68 or the key 28, thereby reducing the likelihood of the plug 14 being inadvertently removed from the cavity 20 of the socket 12. When the plug 14 is desired to be withdrawn from the socket 12, the lid 48 may be lifted against the biasing force, allowing the protuberance 68 or the key 28 to clear the locking tab 52. Although the locking tab 52 of the present embodiment is a part of the lid 48, other embodiments of the present invention may include a differently located locking tab (e.g., on an interior of the socket). Although the protuberance 68 of the present embodiment extends from the housing 54 further than the key 28, other embodiments of the present invention may include a key without an additional protuberance, which may be stopped by a locking tab of the socket when the plug and socket are mated.

The housing 54 may have an interior space 62. Also, the housing may include one or more pull tabs 76 that extend outwardly from the plug housing 54 to facilitate removal of the plug 14 from socket 12, although other embodiments of the present invention may lack pull tabs 76. The plug 14 of the present embodiment includes opposing pull tabs 76 adjacent a rear of housing 54 and extending from the sides of the housing 54, allowing a user to remove the plug 14 from the socket 12 without pulling on the wires exiting the rear of the housing 54, which would otherwise potentially damage the electrical connection between the wires and the electrical terminals (e.g., female terminals 38) of the plug 14.

Referring to FIGS. 3-8, and 11-16, the plug 14 of present embodiment also includes the electrical terminal holder 64 configured to be inserted in a front 66 of the housing 54. The electrical terminal holder 64 of the present embodiment is configured to substantially block the opening at the front 66 of the housing 54 by being inserted into the interior space 62 of the plug housing 54, and by rotating the electrical terminal holder 64 with respect to the housing 54 to engage one or more various engaging mechanisms, as will be described further below.

The electrical terminal holder 64 of the present embodiment includes channels 70 of the plug 14 that match the pin pattern of the male pins 36 of the socket 12, and that are sized to receive electric terminals (e.g., metallic female terminals) 38. Accordingly, the plurality of electrical terminals 38 may extend through, and be fixed by, the electrical terminal holder 64. The electrical terminals 38 may be configured to be inserted into the electrical terminal holder 64, and may have a structure to mechanically engage the electrical terminal holder 64 (for example, see FIG. 2 of U.S. Pat. No. 7,097,469 B2). Connected to the electrical terminals 38 are electrical wires that are housed in the plug housing 54.

Figure 16:
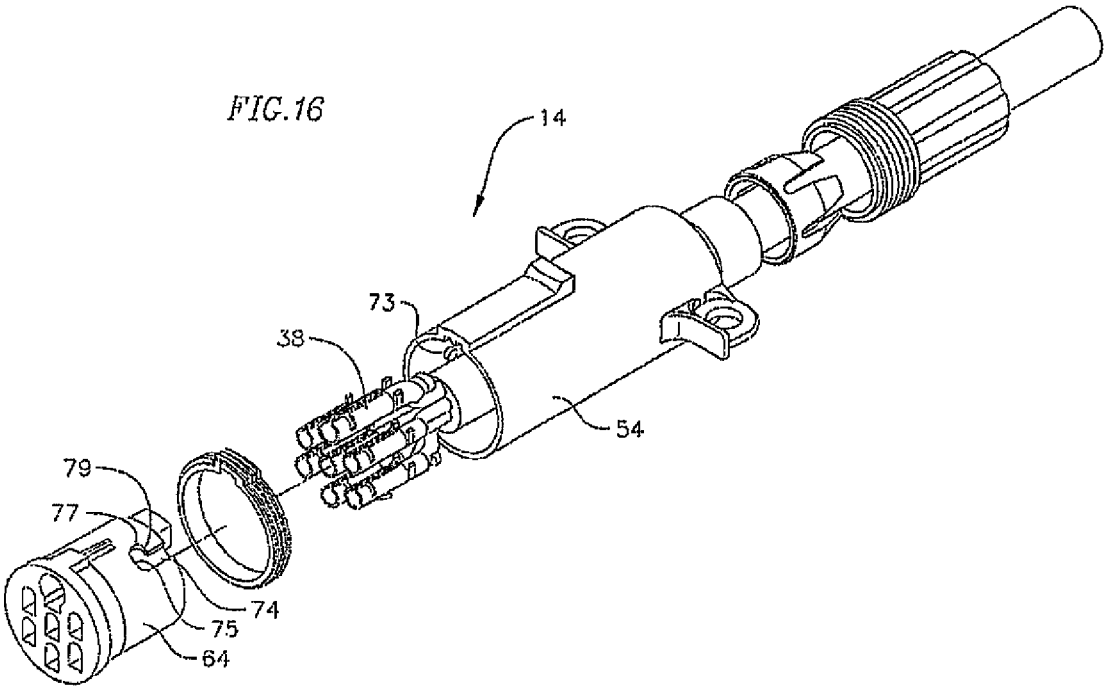
FIG. 16 is an exploded view of the plug of the embodiment shown in FIGS. 13-15.

As can be seen in FIG. 16, the plug housing 54 may have a length that is twice as long, or more, than the length of the terminal holder, such that the points at which the electrical wires are electrically connected to the electrical terminals 38 is also housed in the plug housing 54. When the electrical wires are appropriately electrically connected to the electrical terminals 38, the electrical terminal holder 64 of embodiments of the present invention may be inserted (e.g., partially inserted) into the plug housing 54. To enable the electrical terminal holder 64 to be inserted into the plug housing 54 during assembly, the plug housing 54 may have an inner circumference/inner diameter that is slightly bigger than the outer circumference/outer diameter a main portion/rear of the electrical terminal holder 64.

The electrical terminal holder 64 of the present embodiment is generally cylindrical/circular, and has a flange 99 at a front of the electrical terminal holder 64 that has a diameter that is slightly greater than a diameter of the rest of the electrical terminal holder 64. Further, the electrical terminal holder 64 may have a front end that has an outer diameter/outer circumference substantially equal to that of the plug housing 54, and which is larger than an outer diameter/outer circumference of a main portion of the electrical terminal holder 64. Accordingly, an annular groove 78 may be formed behind the flange 99, between the front of the electrical terminal holder 64 and the front 66 of the plug housing 54 (see FIG. 11) when the electrical terminal holder 64 is inserted into the plug housing 54, such that the annular groove 78 may be within the socket cavity 20 when the plug 14 is mated with the socket 12.

Although the present embodiment depicts an annular groove 78 that is defined by the front 66 of the plug housing 54 and the flange 99 of the electrical terminal holder 64 when the terminal holder 64 is engaged with the housing 54, other embodiments of the present invention may not have the groove 78. In such embodiments, the flange 99 may abut, or directly contact, the front 66 of the housing 54 when the terminal holder 64 is inserted into, and engaged with, the plug housing 54. Accordingly, no seal ring 92 will be necessary in such embodiments. Also, in such embodiments, the act of engaging the terminal holder 64 with the housing 54 may form a seal between the two.

Figure 3:
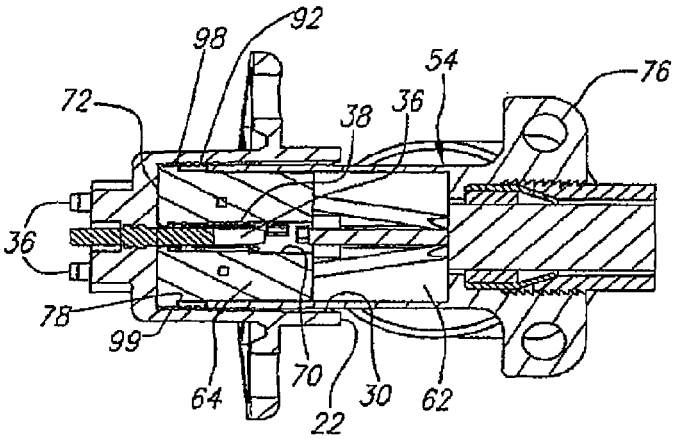
FIG. 3 is a cross-sectional view of the plug and the socket of FIG. 2 taken along the line 3-3.
Figure 4:
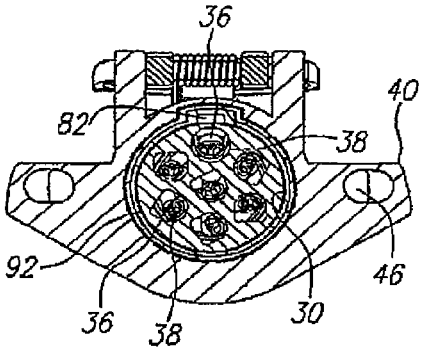
FIG. 4 is a cross-sectional view of the plug and the socket of FIG. 2 taken along the line 4-4.
Figure 5:
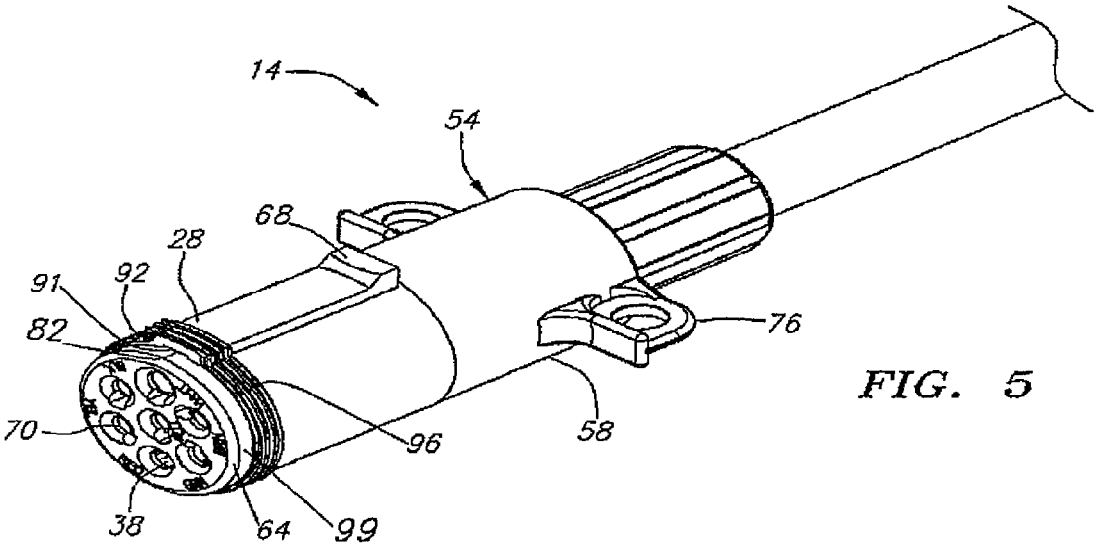
FIG. 5 is a perspective view of the plug of the embodiment shown in FIG. 1.
Figure 6:
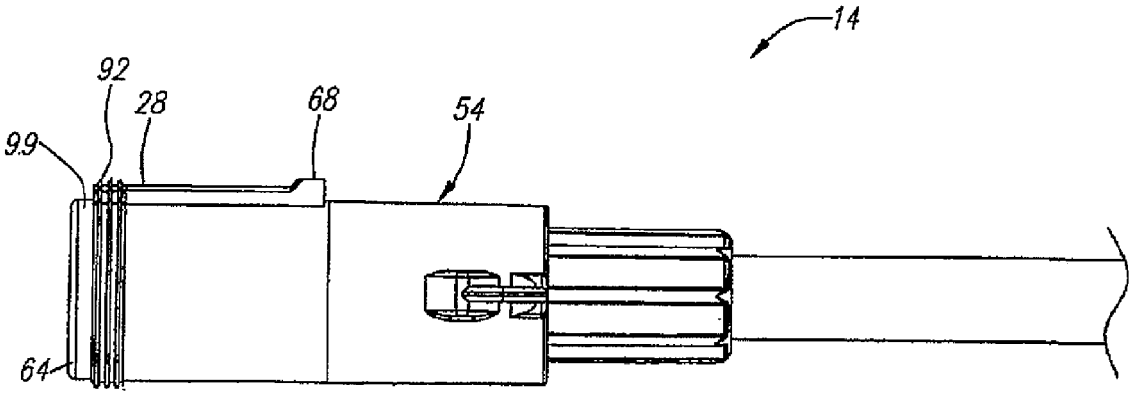
FIG. 6 is a side elevational view of the plug of the embodiment shown in FIG. 1.

In the present embodiment, the resilient seal ring 92 has a width corresponding to that groove 78 in which it is located (e.g., the distance between a rear of the flange 99 of the electrical terminal holder 64 and the front of the housing 54 when the two are engaged) so that the seal ring 92 may be received by the groove 78. Further, the seal ring 92 has an outer profile of a shape and size that is substantially similar to that of the plug housing 54, and has an interior contour that corresponds to the cross-sectional profile of the annular groove 78 so that the seal ring 92 can be tightly fitted around the electrical terminal holder 64 between the flange 99 of the electrical terminal holder 64 and the front 66 of the plug housing 54 within annular groove 78. Because the seal ring 92 is seated within the groove 78, and as shown in FIGS. 2-4, when the plug 14 is mated with the socket 12, the resilient seal ring 92 will be positioned within the cavity 20.

Figure 9:
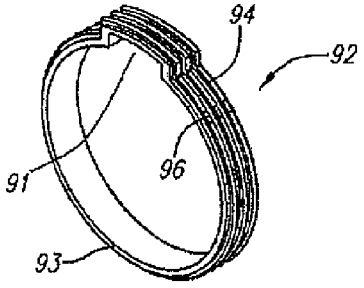
FIG. 9 is a perspective view of a seal ring in accordance with an embodiment of the present invention.
Figure 10:
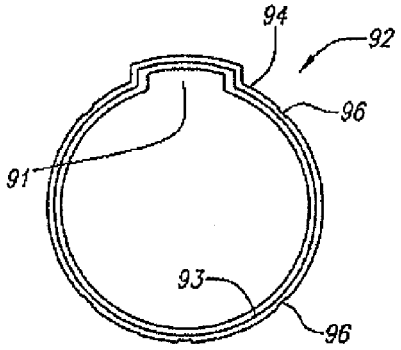
FIG. 10 is a plane view of the seal ring of the embodiment shown in FIG. 9.

Referring to FIGS. 9-10, the resilient seal ring 92 of the present embodiment includes a base portion 93, which seats in the annular groove 78 and a plurality of flexible ribs 94 integrally formed therewith. The flexible ribs 94 extend radially outward from the base 93 about its circumference. In the present embodiment, three flexible ribs 94 are provided, and the seal ring 92 (including the ribs 94) is made from a rubber material, such as EPDM rubber or silicone rubber, although other resilient materials can be used to make the resilient seal ring 92 in other embodiments. In other embodiments, other forms of seal rings may be employed. For example, a different number of ribs may be used. Furthermore, the seal ring 92 of the present embodiment includes a plurality of relief cuts 96 that are formed in the ribs 94 of the seal ring 92 and that are positioned and sized to align with and receive the ribs 42 of the socket 12 when the plug 14 and the socket 12 are mated, although other embodiments of the present invention may lack the relief cuts 96.

When the plug 14 is inserted into the cavity 20 of the socket 12, a substantially sealed internal volume 98 is formed due to the resilient seal ring 92. Because the seal ring 92, including the ribs 94, is made of a generally resilient material, the seal ring 92 conforms to the profile of the interior surface 30 of wall 22 to form a water-resistant, if not water-tight, seal. Furthermore, by using a plurality of ribs 94 (e.g., three in the seal ring of the present embodiment), each rib 94 may form a separate seal with the interior 30 of the socket 12, thereby providing redundant protection from moisture and debris. Therefore, when the plug 14 is mating with the socket 12, the female terminals 38 of plug 14 and the male pins 36 of the socket 12 will be protected from moisture in the environment, thereby reducing the potential for corrosion that moisture and debris may cause.

While embodiments of the invention presented above have been shown and described as comprising a plug with female terminals so that a mating socket has male pins, it is within the scope of the invention for the electrical terminals to be reversed so that the plug has male pins and the mating socket has female terminals, or for the plug and the socket to have other electrical connections. If the plug 14 is constructed to comply with a particular SAE or ISO standard, then the plug 14 will mate with any socket that has also been constructed according to the standard. Thus, the plug 14 of the present patent document will provide water-resistant, if not water-tight seals when coupled to sockets used with existing trucks or trailers.

In the present embodiment, a cross-section of a front of the electrical terminal holder 64 has a shape similar to that of the plug housing 54 and key 28, although the size of the cross-section of the electrical terminal holder 64 is smaller than that of the plug housing 54. Accordingly, the shape of the groove 78 near the front of the electrical terminal holder 64 tracks the outer profile of the plug housing 54/key 28, and may similarly have a key (e.g., a key protrusion) 82 on a side of the electrical terminal holder 64 and extending from the flange 99 (see FIG. 11). In embodiments of the present invention wherein a groove 78 exists (e.g., see FIGS. 11, 15, and 16), the key 82 may be housed by the resilient seal ring 92.

Figure 11:
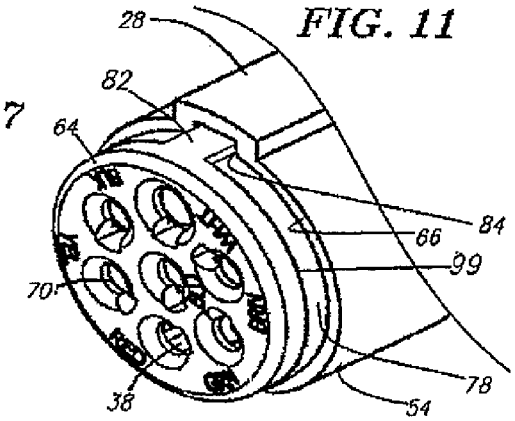
FIG. 11 is a partial perspective view of the electrical terminal holder engaged with the plug housing of an embodiment of the present invention.

In the present embodiment, because the key 82 of the electrical terminal holder 64 extends from the flange 99 of the electrical terminal holder 64, the key 82 is present at a portion of annular groove 78 (see FIG. 11). The presence of the key 82 in the groove 78 is used to position and help retain the seal ring 92 within the annular groove 78. Accordingly, and referring to FIGS. 9 and 10, the seal ring 92 of the present embodiment includes a corresponding recess 91 for receiving at least a portion of the key 82 of the electrical terminal holder 64 proximate the flange 99, and a cross-section of the seal ring 92 has a substantially uniform thickness that is slightly more than the depth of the groove 78 (e.g., slightly more than the width of the side wall of the housing 54). Because the groove 78 tracks the outer profile of the plug housing 54, so does the seal ring 92, wherein the outer profile of the seal ring 92 is slightly further from a central axis of the plug housing 54 than an exterior of the plug housing 54. In other embodiments, the key 82 may be located in other positions of the groove 78, with the corresponding keyway 84 of the housing 54 being correspondingly located. Further, more than one key 82 and more than one corresponding recess in the seal ring 92 may be employed in other embodiments of the present invention.

Now that the plug 14 and socket 12 of embodiments of the present invention have been generally described in their assembled form above, the manner of assembling the plug 14, as well as the components involved therein, will be described.

The electrical terminal holder 64 of embodiments of the present invention may be inserted into the plug housing 54, and may then be twisted (for example, the electrical terminal holder 64 may be rotated in a clockwise direction with respect to the plug housing 54, and may be rotated by, for example, a few degrees) to thereby engage the electrical terminal holder 64 with the plug housing 54 using one or more engaging mechanisms (to be described below), thereby securing the holder 64 to the plug housing 54 to form an assembled plug 14.

Figure 7:
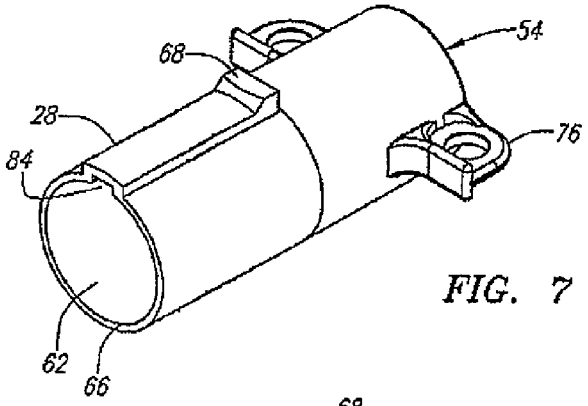
FIG. 7 is a perspective view of a plug housing of the plug of a second embodiment.
Figure 8:
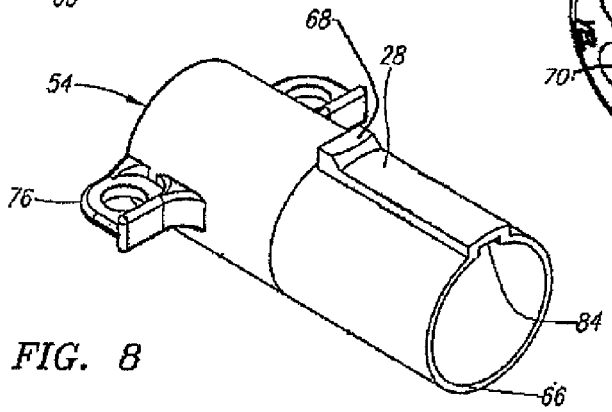
FIG. 8 is a perspective view of the plug housing of the plug of the embodiment shown in FIG. 7.
Figure 12:
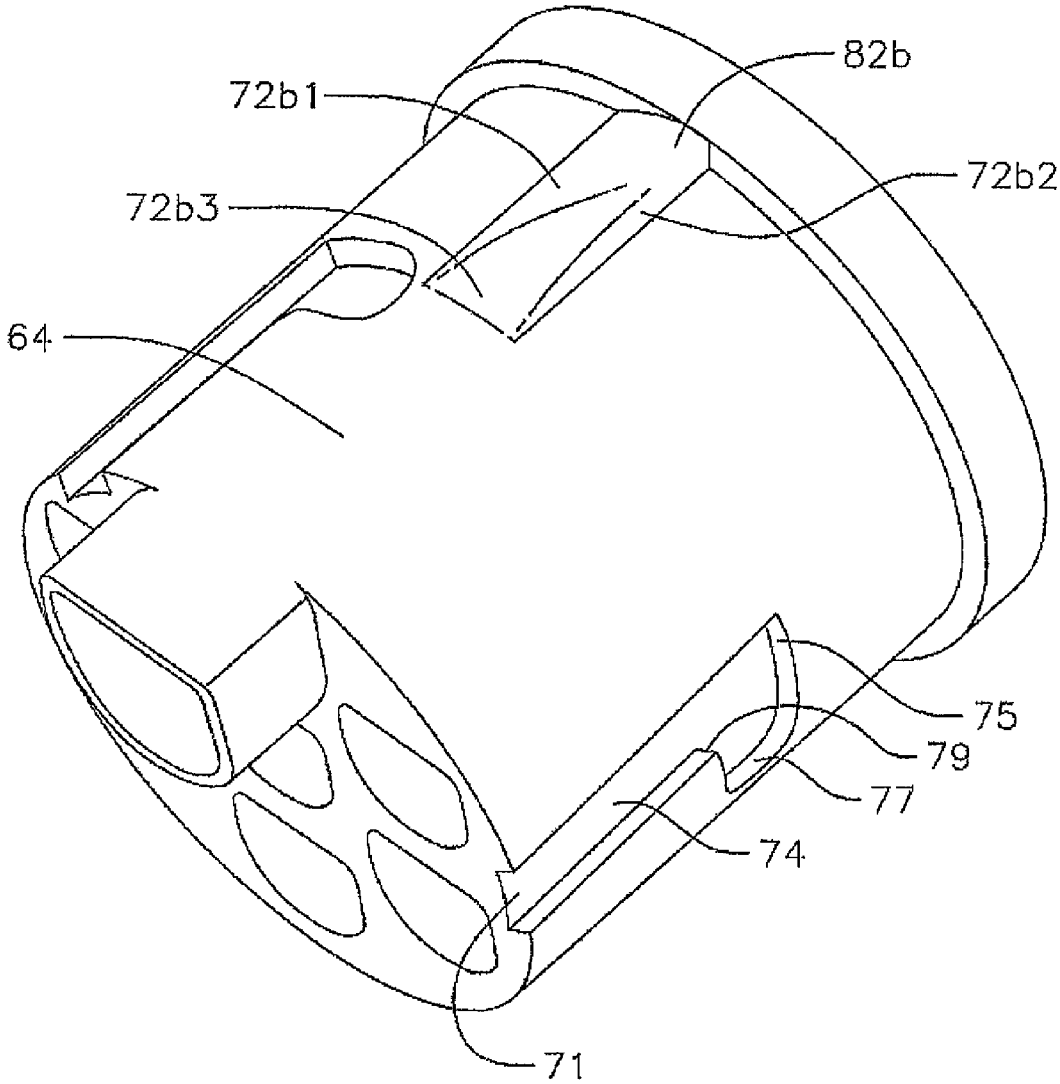
FIG. 12 is a perspective view of a rear of the electrical terminal holder of the plug of the embodiment shown in FIGS. 7 and 8.
Figure 13:
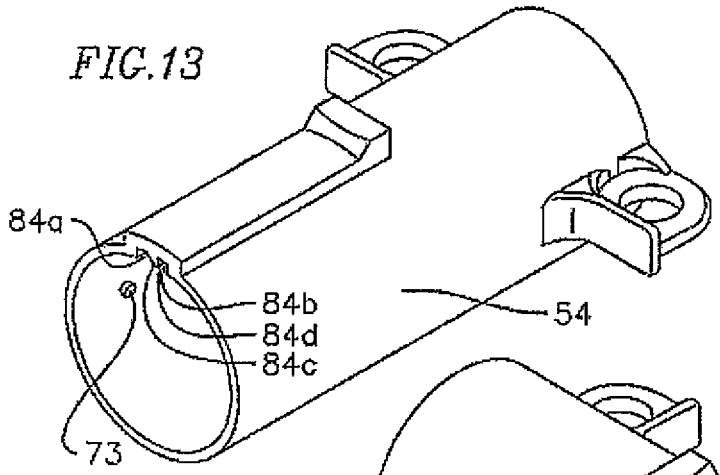
FIG. 13 is a perspective view of a plug housing of the plug of the embodiment shown in FIG. 11.
Figure 14:
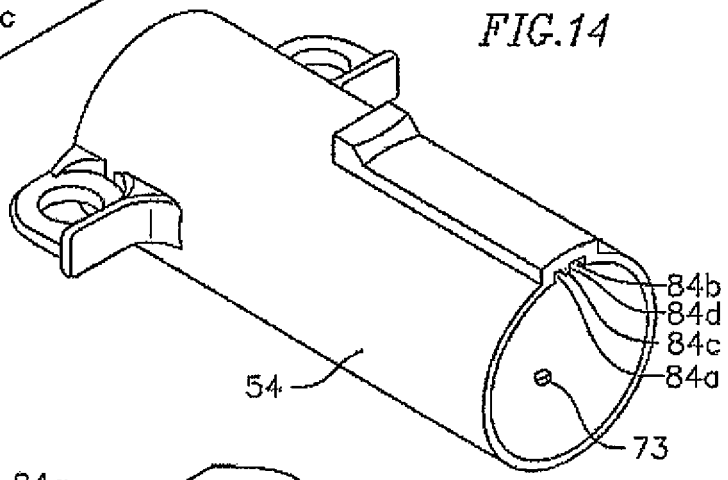
FIG. 14 is a perspective view of the plug housing of the plug of the embodiment shown in FIG. 13.

Referring to FIGS. 7, 8, and 12, in one embodiment of the present invention, the key-like protrusion 82*b* of the terminal holder 64 may be different from the previously described key 82 in that it is wedge shaped, having a sloped side 72*b*1 on the leading edge 72*b*1 with respect to the twisting direction, and a blunt/flat side 72*b*2 on the trailing edge 72*b*2 with respect to the twisting direction.

Accordingly, and for example, if the terminal holder 64 is to be twisted in a clockwise direction with respect to the plug housing 54, when in the engaged position, if the protrusion 82*b* was pointing upwards, the blunt/flat trailing edge 72*b*2 would be on the left, and would rest on an inner surface of the plug housing 54 that defines a side of the keyway 84. Furthermore, because the protrusion 82*b* will not be directly aligned with the keyway 84 when the terminal holder 64 is inserted into the plug housing 54, the rear 72*b*3 of the protrusion 82*b* may also be sloped. Accordingly, the plug housing 54 may be slightly temporarily deformed, or stretched, when the terminal holder 64 is initially inserted into the plug housing 54. However, the plug housing 54 may then return to its intended shape when the terminal holder 64 is twisted with respect to, and thereby engaged with, the plug housing 54, as the protrusion 82*b* will then be aligned with, and partially encompassed by, the keyway 84. In the present embodiment, the terminal holder 64 may be inserted into the housing 54 such that the flange 99 directly contacts the front 66 of the housing when the protrusion 82*b* is within the keyway 84.

Referring to FIGS. 11-16, in other embodiments, the engaging mechanism may include a structure of slots 74 and protrusions (e.g., inner protrusions) 73. It should also be noted that the slots 74 and protrusions 73 of the present embodiment may also be used in conjunction with, or independently of, the previously described embodiment of FIGS. 7, 8, and 12 having the protrusion 82*b*.

The inner surface of the plug housing 54 may have one or more protrusions 73 (e.g., three protrusions 73) that are no farther from the front of the plug housing 54 than the length of the terminal holder 64 (so that they can engage the terminal holder 64). The terminal holder 64 may have one or more slots 74 (each slot 74 corresponding to one of the protrusions 73). Accordingly, the protrusion(s) 73 may engage with the slot(s) 74 when the terminal holder 64 is inserted into the plug housing 54.

The slots 74 may have a beginning/opening 71 at the rear face of the terminal holder 64. The slots may have an "L" shape, a "J" shape, or a hook shape. Accordingly, when the terminal holder 64 is inserted into the plug housing 54, each of the protrusions 73 enter the corresponding ones of the slots 74 and slide along a first portion of the slots 74 toward the back/end 75 of the slots 74. Once the protrusions 73 contact the back 75 of the slots 74, the terminal holder 64 will not be able to be inserted into the plug housing 54 any further. Then, the terminal holder 64 may be twisted with respect to the plug housing 54 to cause the protrusions to move from the first portion of the slots 74 and to move along the second portion of the slots 74. After passing along the length of the second portion of the slots, the protrusions 73 may be placed at an end/bottom 77 of the slots 74 (e.g., the lower/outermost part of the "L," or "J").

Upon twisting the terminal holder 64 with respect to the plug housing 54, each protrusion 73 may pass a bump/ridge 79 of the corresponding slot 74. This may allow for more secure engagement of the plug housing 54 to the terminal holder 64 by making it more difficult to untwist the assembly.

Referring to FIGS. 11 and 13-16, in an alternative embodiment of the present invention, the inner surface of the plug housing 54 may have two keyways 84*a* and 84*b* at its front 66 corresponding to the protrusion/key 82 at the front of the terminal holder 64, which may be located in front of (as shown in FIG. 11) the keyway 84 of the plug housing 54.

Figure 15:
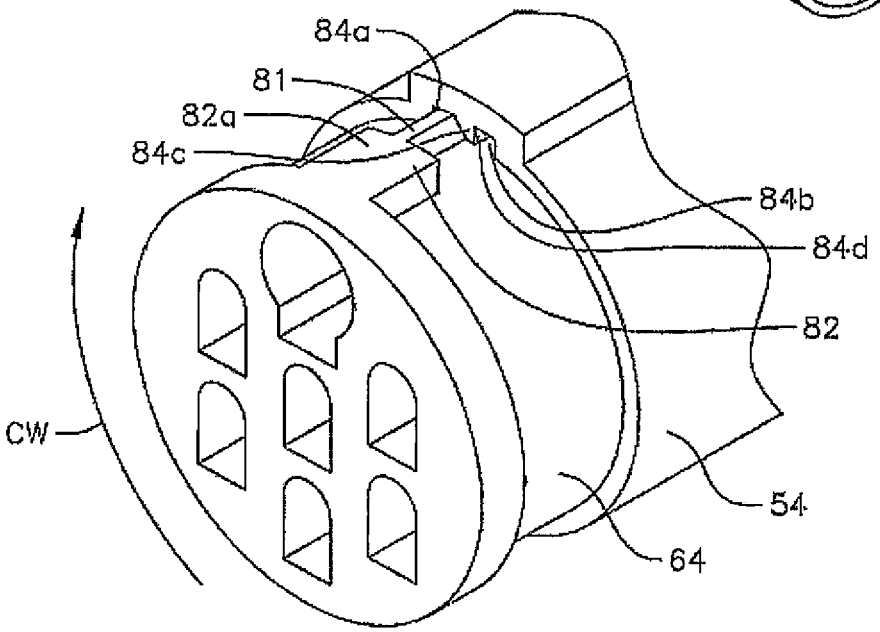
FIG. 15 is a perspective view of the electrical terminal holder partially inserted into the plug housing of the plug of the embodiment shown in FIGS. 13-14.

Referring to FIG. 15, the two keyways 84*a* and 84*b* may be separated by an inner wedge/ridge 84*c*. In the present embodiment, the ridge 84*c* is wedge-shaped, and has a thickness that increases in the twisting direction. However, in other embodiments, the ridge may be a bump extending in the length direction of the plug housing 54 and that is rounded on a leading edge, with respect to the twisting direction, but flatter on the trailing edge for the purpose of securing the terminal holder 64 in place within the plug housing 54.

In the present embodiment, the outer surface of the terminal holder 64 may have ridge 81 at the rear of the key-like protrusion 82 (extending from a front portion 82*a* of the key-like protrusion 82) corresponding to the two grooves/keyways 84*a* and 84*b* and the inner wedge 84*c*. Similar to the ridge 84*c* of the plug housing 54, although the ridge 81 of the present embodiment is wedge-shaped, thereby making it easier to twist the terminal holder 64 with respect to the plug housing into an engaging position, other embodiments may have a differently shaped ridge (e.g., wherein the ridge is rounded on a leading edge and flat on a trailing edge, with respect to a twisting direction, to facilitate securing of the terminal holder 64 within the plug housing 54).

Accordingly, when the terminal holder 64 is aligned and inserted into the plug housing 54 such that the protrusions 73 are placed into the opening of the slots 74, the ridge 81 of the terminal holder 64 is also inserted into a first keyway 84*a* (see FIG. 15). Then, when the protrusions 73 reach the back 75 of the slots 74, and when the terminal holder 64 is twisted with respect to the plug housing 54 (e.g., in a clockwise CW direction), the ridge 81 passes over the wedge 84*c*, moving from the first keyway 84*a* to the second keyway 84*b*. When the terminal holder 64 and plug housing 54 are fully engaged, the ridge 81 will be on a flat side 84*d* of the wedge 84*c*, thereby further securing the terminal holder 64 to the plug housing 54. This may make it easier for a user to engage the plug housing 54 to the terminal holder 64 during assembly than it is to disengage these components, thereby further securing the plug housing 54 to the terminal holder 64.

Further, and referring to FIG. 11, by fully inserting the ridge 81 into the first keyway 84*a* and engaging the terminal holder 64 to the housing 54, the key 82 may block the first and second keyways 84 *a* and 84*b* from the external environment.

In embodiments of the present invention, the electrical terminal holder 64 may have a front that is flanged/flared, and has an outer circumference/diameter that is substantially equal to that of the plug housing 54. When the electrical terminal holder 64 is inserted into, and engaged with, the plug housing 54, the rear of the flange may abut the front end of the plug housing 54. In alternative embodiments, the engaged housing and electrical terminal holder 64 may define a groove defined by the rear of the flange, the front of the housing, and the circumference of the outer surface of the main portion of the electrical terminal holder 64. This groove may be used for a seal to be set therein (see FIG. 11).

Other embodiments of the present invention may have other engaging mechanisms to engage the terminal holder 64 to the plug housing 54. For example, the slots may be defined by a surface of the plug housing 54 with the protrusions on the terminal holder 64, or where a ridge of the plug housing 54 is inserted into a keyway of the terminal holder 64.

Furthermore, although the present invention has been particularly shown and described with reference to exemplary embodiments thereof, it will be understood by those of ordinary skill in the art that features of different embodiments may be combined to form further embodiments, and that various changes, modifications and adaptations in form and details of the invention are possible without departure from the spirit and scope of the invention. Thus the present invention has been described by way of illustration and not limitation, and is defined by the following claims and their equivalents.

What is claimed is:

1. An electrical connector comprising:

a housing for housing an electrical terminal, the housing being substantially tubular; and a terminal holder configured to be inserted into the housing, the terminal holder being substantially cylindrical and configured to hold the electrical terminal, wherein the terminal holder and the housing are configured to be mechanically engaged by twisting the terminal holder with respect to the housing after being inserted therein, wherein the housing comprises a keyway defined by an inner wall of the housing and extending in a length direction of the housing, wherein the terminal holder comprises a key protrusion at a side of the terminal holder, and wherein the key protrusion is configured to be inserted into the keyway of the housing and to securely engage the keyway when the terminal holder is twisted with respect to the housing.

2. An electrical connector comprising:

a housing for housing an electrical terminal, the housing being substantially tubular; and a terminal holder configured to be inserted into the housing, the terminal holder being substantially cylindrical and configured to hold the electrical terminal, wherein the terminal holder and the housing are configured to be mechanically engaged by twisting the terminal holder with respect to the housing after being inserted therein, wherein the housing comprises a first ridge at an inner wall of the housing and extending in a length direction of the housing, wherein the first ridge and the inner wall of the housing define a first keyway and a second keyway that are separated by a first ridge, wherein the terminal holder comprises a second ridge corresponding to the first ridge and located at a side of the terminal holder and extending in a length direction of the terminal holder, wherein the second ridge is configured to be inserted into the first keyway when the terminal holder is inserted into the housing, and wherein the second ridge is configured to pass the first ridge to reside in the second keyway when the terminal holder is twisted with respect to the housing.

3. The electrical connector of claim 1, wherein the key protrusion is wedge-shaped and is configured to slidably engage the keyway of the housing when the terminal holder is twisted with respect to the housing.

4. The electrical connector of claim 1, wherein the housing comprises an inner protrusion at an inner wall of the housing, and wherein the terminal holder comprises a slot at a side of the terminal holder that is configured to have the inner protrusion situated therein.

5. The electrical connector of claim 4, wherein the terminal holder is configured to engage the inner protrusion in the slot when the terminal holder is twisted with respect to the housing.

6. An electrical connector comprising:

a housing being substantially tubular and having:

a front end;

a rear end; and a side wall between the front end and the rear end and comprising one or more inner protrusions on an inner side of the side wall; and a terminal holder being substantially cylindrical and comprising:

a front;

a rear; and a side between the front and rear and defining one or more slots corresponding to the one or more inner protrusions of the tubular housing, wherein the one or more inner protrusions are configured to be engaged with corresponding ones of the slots when the terminal holder is inserted into the housing, wherein the housing comprises a keyway defined by an inner wall of the housing and extending in a length direction of the housing, wherein the terminal holder comprises a key protrusion at a side of the terminal holder, and wherein the key protrusion is configured to be inserted into the keyway of the housing and to securely engage the keyway when the terminal holder is twisted with respect to the housing.

7. The electrical connector of claim 6, wherein the one or more inner protrusions are configured to be engaged with the corresponding ones of the slots when the terminal holder is inserted into the housing and twisted with respect to the housing.

8. The electrical connector of claim 6, wherein each of the one or more slots have:

a first portion extending in a length direction of the terminal holder and having:

an opening at the rear of the terminal holder; and a back between the front and the rear of the terminal holder; and a second portion extending from the back of the first portion at an angle to the first portion.

9. The electrical connector of claim 8, wherein each of the one or more slots may be further defined by a ridge where the first portion meets the second portion and that is configured to exert a biasing force on a corresponding one of the one or more inner protrusions in the second portion.

10. An electrical connector comprising:

a housing being substantially tubular and having:

a front end;

a rear end; and a side wall between the front end and the rear end and comprising one or more inner protrusions on an inner side of the side wall; and a terminal holder being substantially cylindrical and comprising:

a front;

a rear; and a side between the front and rear and defining one or more slots corresponding to the one or more inner protrusions of the housing, wherein the one or more inner protrusions are configured to be engaged with corresponding ones of the slots when the terminal holder is inserted into the housing, wherein the side wall of the housing defines a first keyway and a second keyway extending from the front end toward the rear end, wherein the side wall of the housing further comprises a first ridge at the inner side of the side wall and extending from the front end toward the rear end, the first ridge defining respective edges of the first and second keyways, and wherein the terminal holder further comprises a second ridge on the side of the terminal holder and extending in a length direction of the terminal holder.

11. The electrical connector of claim 10, wherein the second ridge is configured to pass from the first keyway over the first ridge and into the second keyway when the terminal holder is inserted into the housing and twisted with respect to the housing.

12. The electrical connector of claim 11, wherein the first and second ridges are wedge-shaped, the first ridge having a first flat end extending radially inward from the inner side wall, and the second ridge having a second flat end extending radially outward from the side of the terminal holder, and wherein the first flat end is configured to abut second flat ends when the terminal holder is inserted into the housing and twisted with respect to the housing.

13. The electrical connector of claim 6, wherein the terminal holder further comprises a flange at the front of the terminal holder, the flange having an outer diameter approximately equal to an outer diameter of the housing, and wherein a groove is defined by the flange, the side of the terminal holder, and the front end of housing when the terminal holder is twisted inserted into the housing and twisted with respect to the housing.

14. The electrical connector of claim 13, wherein the groove is configured to accommodate a seal configured to prevent or reduce moisture or debris passing into the front of the housing.

15. An electrical connector comprising:

a housing being substantially tubular and having:

a front end;

a rear end; and a side wall between the front end and the rear end and comprising one or more inner protrusions on an inner side of the side wall; and a terminal holder being substantially cylindrical and comprising:

a front;

a rear; and a side between the front and rear and defining one or more slots corresponding to the one or more inner protrusions of the housing, wherein the one or more inner protrusions are configured to be engaged with corresponding ones of the slots when the terminal holder is inserted into the housing, wherein the inner side of the side wall of the housing defines a keyway extending from the front end of the housing toward the rear end of the housing, wherein the side of the terminal holder comprises a wedge corresponding to the keyway of the housing, and wherein a flat side of the wedge extending outwardly from the side of the terminal holder is configured to abut a portion of the inner side of the side wall of the housing that defines a portion of the keyway when the terminal holder is inserted into the housing and twisted with respect to the housing.

16. The electrical connector of claim 15, wherein the wedge is sloped in a length direction of the terminal holder, and is also sloped in a circumferential direction of the terminal holder.

17. The electrical connector of claim 16, wherein the wedge is configured to be wedged beneath an area of the housing next to the keyway to slightly deform the housing when the terminal holder is inserted into the housing, and is configured to pass into the keyway when the terminal holder is twisted with respect to the housing.

* * * * *